US005245956A

United States Patent [19]

Martin

[11] Patent Number: 5,245,956

[45] Date of Patent: Sep. 21, 1993

[54] REED VALVE ASSEMBLY

[75] Inventor: James C. Martin, Portland, Oreg.

[73] Assignee: Barry Davidson, Boring, Oreg.

[21] Appl. No.: 3,100

[22] Filed: Jan. 11, 1993

[51] Int. Cl.[5] ..... F02B 33/04

[52] U.S. Cl. ..... 123/73 V; 137/512.1

[58] Field of Search ..... 123/73 V, 73 A, 65 V; 137/512.1, 512.15, 855, 845, 852

[56] References Cited

U.S. PATENT DOCUMENTS

| | | | |
|---|---|---|---|
| 2,199,307 | 4/1940 | Eichelberg | 277/60 |
| 2,505,757 | 5/1950 | Dunbar et al. | 60/35.6 |
| 2,689,552 | 9/1954 | Kiekhaefer | 123/73 |
| 4,228,770 | 10/1980 | Boyesen | 123/73 V |
| 4,294,202 | 10/1981 | Boyesen | 123/73 V |
| 4,474,145 | 10/1984 | Boyesen | 137/512.1 |
| 4,690,107 | 9/1987 | Emler et al. | 123/65 V |
| 4,691,623 | 9/1987 | Mizusawa | 137/512.15 |
| 4,748,944 | 6/1988 | Iida et al. | 123/73 V |
| 4,836,151 | 6/1989 | Litjens et al. | 123/65 V |
| 4,879,976 | 11/1989 | Boyesen | 123/651 |
| 4,970,996 | 11/1990 | Matsuo et al. | 123/73 V |
| 5,036,806 | 8/1991 | Rarick | 123/65 V |
| 5,103,867 | 4/1992 | Wu | 123/512.1 |

FOREIGN PATENT DOCUMENTS

| | | | |
|---|---|---|---|
| 0157922 | 12/1982 | Fed. Rep. of Germany | 123/73 V |

*Primary Examiner*—E. Rollins Cross
*Assistant Examiner*—M. Macy
*Attorney, Agent, or Firm*—Dellett and Walters

[57] ABSTRACT

A reed valve assembly includes a two ported base member adapted for placement within a fuel/air supply of an engine. The base has a reed cage with first and second reed cage faces defined on the downstream face such that the faces of the reed cage define an upright V opening downstream relative to the base. Reed petals cover openings in the reed cage faces and prevent back flow from the downstream side to the upstream side of the valve assembly. Flow from the upstream side to the downstream side is accomplished by the reed petals flexing towards one another. The reed petals are held in place by a clamping bar, which allows adjustment of the flexing tension for fine tuning of valve operation.

25 Claims, 6 Drawing Sheets

REED VALVE ASSEMBLY

BACKGROUND OF THE INVENTION

This invention relates to reed valves and more particularly to a reed valve assembly for application in a two stroke internal combustion engine.

Reed valves are often employed within fuel/air intake ports of two-cycle internal combustion engines. Typically, the valve consists of a reed cage with an inverted-V shape relative to the bolt flange (base member) and having valve seats and flexible reed petals. During the induction phase of operation of the engine, pressure difference across the valve causes the petals to flex away from the valve seats and allow flow of air through the valve. As the pressure difference drops, the valve tends to close. In operation, fluid dynamic effects result in the reed petals trying to adhere to the flow of air through the valve. Thus, in a configuration employing a single row of reed petals, the petals will tend to close when the rate of flow of air passing through the valve reduces. However, such closing may adversely affect the performance of the engine in which the valve is mounted.

Each petal is held in place over its valve seat via a machine screw or bolt on the downstream face of the reed cage. In the event of the screw coming loose during engine operation, such an arrangement might result in the screw being sucked into the engine cylinder.

It is often desirable to be able to adjust the opening characteristics of a reed valve in order to tune an engine to provide power over a different range of engine speed. However, adjustment and fine tuning beyond the factory setting has not typically been possible with conventional reed valves.

SUMMARY OF THE INVENTION

A reed valve assembly according to the present invention includes a base member adapted to be mounted in a fuel and air supply conduit of an internal combustion engine. The base member has an upstream face and a downstream face, with a main clamping channel defined in the downstream face having first and second longitudinal edges. The base member has first and second valve passages defined adjacent the first and second longitudinal edges of the channel for enabling fuel and air to flow from the upstream face to the downstream face. A reed cage has a first reed cage face that extends obliquely from the first longitudinal edge of the main clamping channel, over the first valve passage to beyond the downstream face of the base member. The reed cage also has a second reed cage face that extends obliquely from the second longitudinal edge of the main clamping channel over the second valve passage to beyond the downstream face of the base member. First and second flexible reed petals are adapted to fit along the inner vertex bases of the first and second reed cage faces, extending towards the outer vertices of the reed cage so as to substantially cover the respective valve passages when in closed states. The first and second flexible reed petals are positioned facing each other so as to flex towards one another when in the open state.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
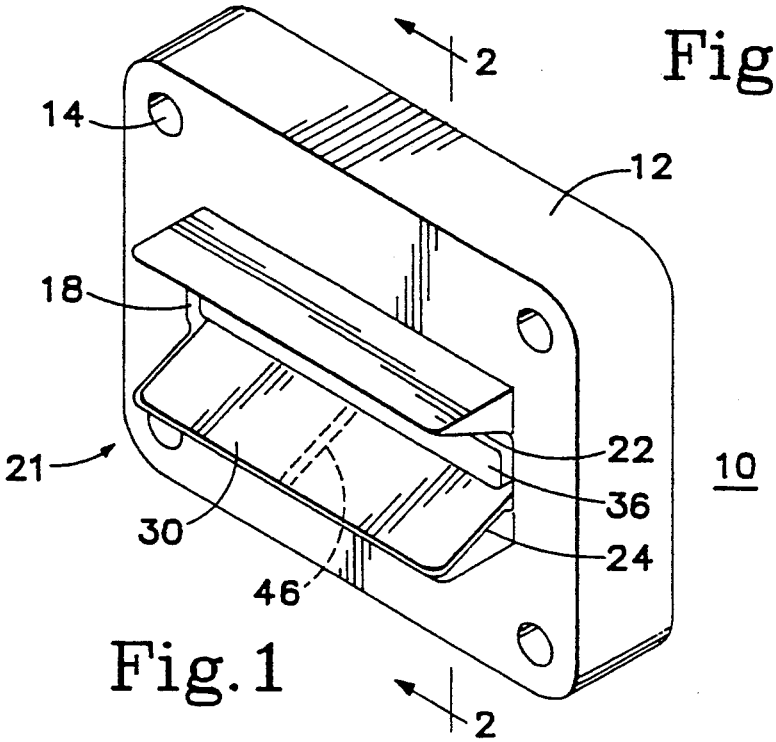
FIG. 1 is a perspective view of a reed valve assembly.
Figure 2:
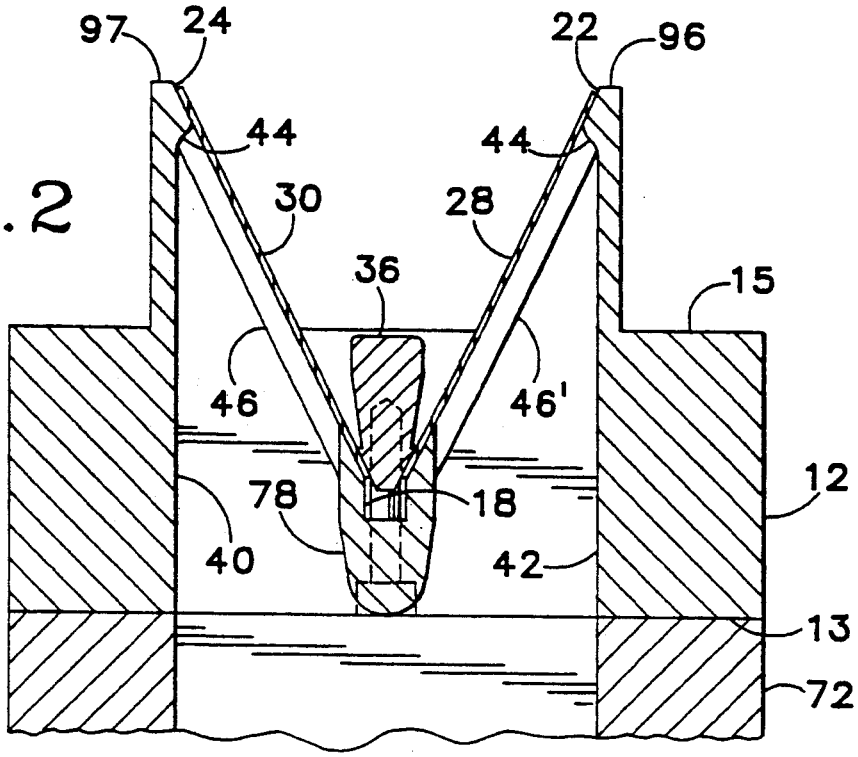
FIG. 2 is a section view of the reed valve assembly of FIG. 1 installed within an internal combustion engine, the section being taken on line 2—2 of FIG. 1.
Figure 3:
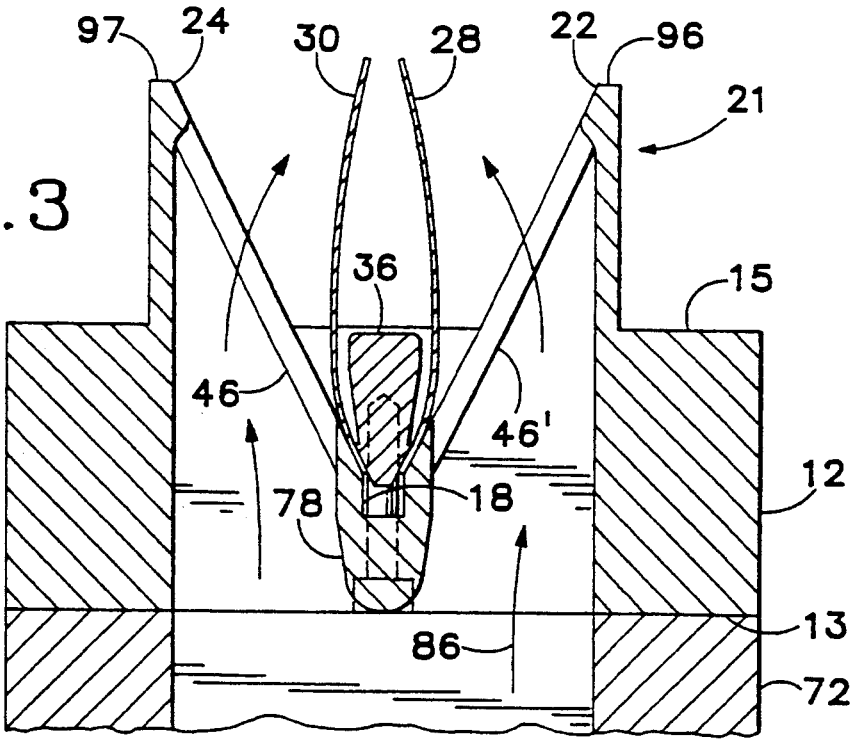
FIG. 3 is a section view of the reed valve assembly of FIG. 1 with the reeds in the open state illustrating fuel/air flow therethrough.

FIGS. 1-3 show a reed valve assembly 10 which includes rectangular base member 12, with mounting holes 14 provided therein, suitably one mounting hole at each corner of the base member, or as required by the bolt pattern of the engine in which the reed valve assembly will be installed. A main clamping channel 18 is formed in one face of the base member. The main clamping channel is roughly centrally placed on the face of the base member and extends substantially the entire length of the face of the base member, or as required by the size of the specific engine. A reed cage 21 having first and second reed cage faces 22 and 24 is formed along respective edges of the main clamping channel. The reed cage and its faces are of upright V configuration relative to the face of the base member unlike the inverted-V configuration typical of the prior art, with each face of the upright V of cage 21 originating within the main clamping channel. The cage extends a substantial distance beyond the surface of the base member such that the outer vertex 96 of cage face 22 and the outer vertex 97 of cage face 24 are some distance beyond the face of the base member. Reed petal 28, visible in FIGS. 2 and 3 and reed petal 30 lay against opposing cage faces 22 and 24 respectively, extending substantially from the base of each cage face to the outer vertex thereof and running substantially the width of the reed cage, or as required by the size of the specific engine. Clamping bar 36 fits within main clamping channel 18.

The operation of the reed valve assembly may be better understood with reference to FIGS. 2 and 3. As shown in FIG. 2, the base member 12 is mounted against intake flange 72. When so mounted, the reed valve assembly has a base flange face 13 that is upstream and a base flange face 15 that is downstream relative to fuel/air flow. Upstream from the reed valve is a carburetor, not shown.

The reed cage 21 has an aperture 44 defined on each face thereof, the apertures being of lesser dimension than the overall dimension of the reed petals, which are adapted to cover the apertures. Base member 12 has two apertures 40 and 42 defined therein, extending from the face 13 up to the apertures 44 in the reed cage. A central portion 78 of the base member separates the two apertures 40 and 42, and has channel 18 defined therein. The two apertures 40 and 42 and their corresponding reed cage faces may be considered to be like Siamese twins, joined at central portion 78 and sharing main clamping channel 18 and clamping bar 36 at a common central region of the reed cage. Support members 46 and 46' provide extra support to the reed petals in the central portion of the apertures 44 when the reed petals are in the closed position. The support members, the vertices of the reed cage faces and the portion 78 of base member 12 that separates aperture 40 and aperture 42 are all suitably formed with aerodynamic principles in mind, having curved leading edges, in order to reduce turbulence within the fuel/air stream.

In the illustration of FIG. 2, the reed petals are shown in a closed state. Referring to FIG. 3, the reed petals are illustrated in the fully open state. Fuel and air flow 86 comes from the carburetor, through the reed valve assembly, pushing the reed petals into their open states, and continuing on to the engine cylinder. The arrangement of petals 28 and 30 and their opening towards each other provides additional urging for the petals to remain open when air flow is present. The back-to-back relation of the apertures results in a divided air flow that rejoins downstream from the valve assembly. The petals attempt to follow this rejoining of the air stream, and therefore tend to be pulled toward one another, which is one reason for employing the upright V configuration reed cage. Once the engine completes an intake cycle, the flow of fuel/air will stop, and the reed petals will return to their closed state, effectively sealing the apertures to prevent back flow from the cylinder to the carburetor.

Figure 5:
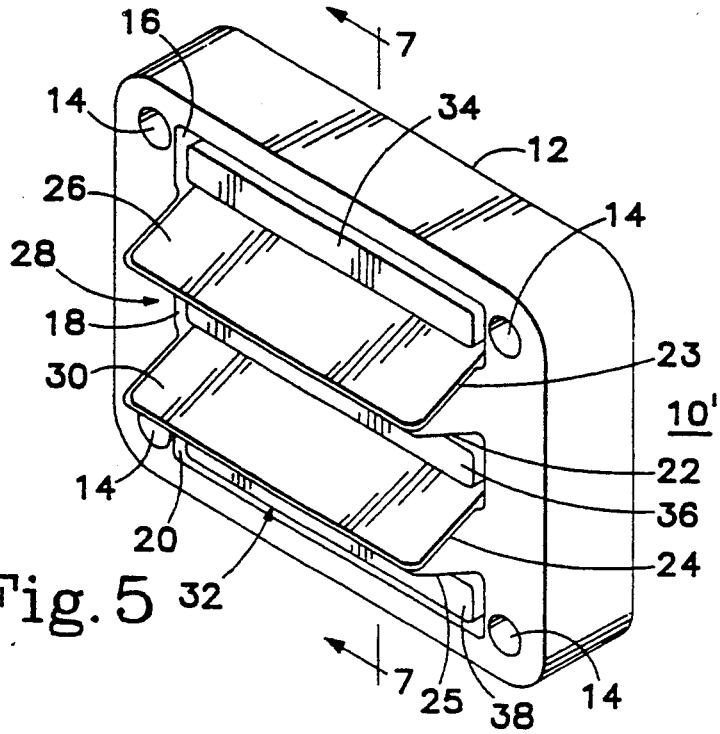
FIG. 5 is a perspective view of a second embodiment of a reed valve assembly.
Figure 6:
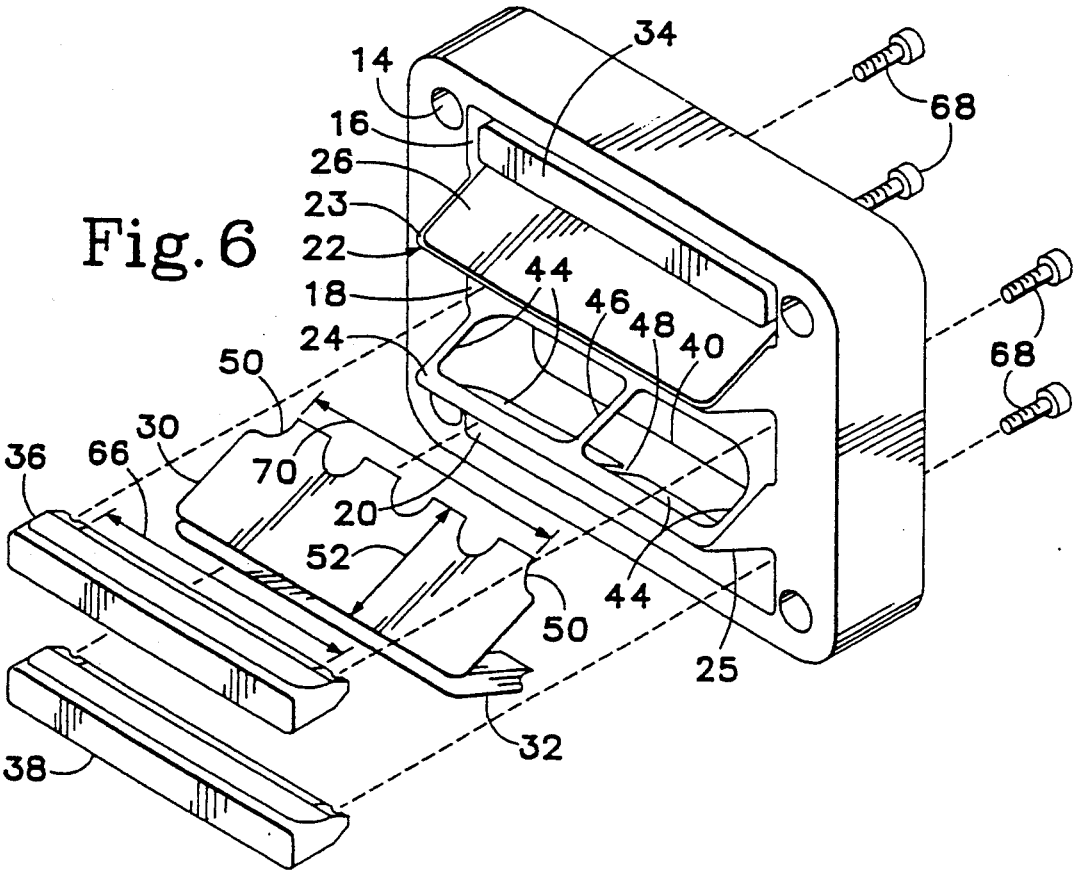
FIG. 6 is a partially exploded perspective view of the reed valve assembly of FIG. 5.

FIGS. 5 and 6 illustrate a reed valve assembly 10' which is similar to reed valve 10 of FIGS. 1-3, but employing two auxiliary reed petals in addition to the two central reed petals. Reference numerals in FIGS. 5 and 6 that are identical to those of FIGS. 1-3 refer to identical elements as described with reference to FIGS. 1-3, except as pointed out hereinbelow. Reed valve 10' has three parallel channels, auxiliary clamping channel 16, main clamping channel 18 and auxiliary clamping channel 20, formed in one face of the base member. The channels are roughly equally spaced on the face of the base member and extend substantially the entire length of the face of the base member, with auxiliary clamping channels 16 and 20 running along opposing edges of the base and main clamping channel 18 being placed centrally of the base, but both the placement and length of the channels may be modified in accordance with the required fuel/air flow through the valve. Reed cage 21 spans between the auxiliary clamping channels, a first auxiliary portion reaching between auxiliary clamping channel 16 and outer vertex 96, a second central portion reaching between outer vertices 96 and 97 and a third auxiliary portion reaching between outer vertex 97 and auxiliary clamping channel 20. As in the embodiment of FIGS. 1-3, the reed cage faces 22 and 24 are of upright V configuration relative to the face of the base member, with each leg of the upright V of cage face 22 and cage face 24 originating within main clamping channel 18 and extending a substantial distance beyond the surface of the base member such that the outer vertices 96 and 97 of each reed cage face are some distance beyond the face of the base member. The distance may be changed as required by the size of the reed cage used on a particular engine. Reed valve 10' further employs auxiliary reed cage faces 23 and 25, auxiliary face 23 originating in auxiliary clamping channel 16 and extending upward to meet main face 22 at outer vertex 96 and auxiliary face 25 originating in auxiliary clamping channel 20 and extending upward to meet main face 24 at outer vertex 97. Each face of each reed cage has an opening therein. Reed petals 28, 30 and 26, 32 lay against reed cage faces 22 and 24 and auxiliary reed cage faces 23 and 25 respectively, extending substantially from the base of each cage face to the vertex thereof and running substantially the width of each cage face. Reed petals 28 and 32 are not visible in FIG. 5. Three clamping bars 34, 36 and 38 are provided, wherein auxiliary clamping bar 34 fits within auxiliary clamping channel 16, main clamping bar 36 fits within main clamping channel 18 and auxiliary clamping bar 38 fits within auxiliary clamping channel 20.

Referring now to FIG. 6 it may be observed that base member 12 has an aperture 40 defined therein below and extending between main cage face 24 and auxiliary face 25. A corresponding aperture 42, not visible in FIG. 6, is defined below reed cage 21 between main cage face 22 and auxiliary face 23. Reed cage 21 has apertures 44 formed along each cage face and auxiliary face thereof and in communication with the base member apertures 40 and 42, each of the corners of the apertures taking on a somewhat curvilinear shape. The respective bases of apertures 44 extend to below the face of base member 12. Support member 46 and support member 48 extend from the base of reed cage face 24 and auxiliary face 25 up to the vertex thereof and divide the respective apertures 44 into two portions along each face of the reed cage. Reed cage face 22 and auxiliary face 23 have support members 46' and 48' (FIG. 7) corresponding to support member 46 and 48.

The reed petals 26, 28, 30 and 32 are of substantially the same configuration relative to one another. Considering exemplary reed petal 30, the petal has a series of semicircular or U-shaped cut outs 50 along the bottom edge thereof, the edge adapted to fit along the base of reed cage face 24. The height of reed petal 30 along line 52, is slightly greater than the length of one face of the reed cage so as to extend down into main clamping channel 18.

Figure 4:
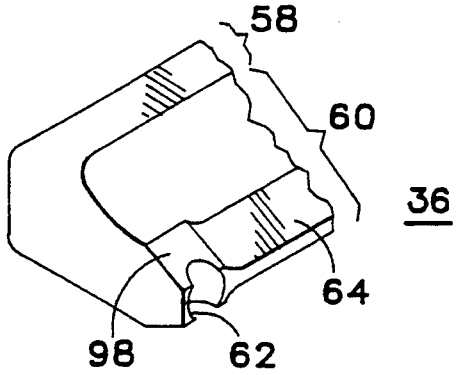
FIG. 4 is a more detailed partial view of a reed clamping bar of the reed valve assembly.

Referring to FIG. 4, a more detailed view of reed valve assembly clamping bar 36, the bar is wedge shaped and comprises a top portion 58 and a tapered bottom portion 60, adapted to fit within main clamping channel 18 of the base member. Threaded holes 62, placed near the terminal ends of the bottom portion of the clamping bar, extend at least partially up into the body of the bar. Beginning approximately at a first hole 62 and extending along a lower face of tapered bottom portion 60 to roughly the center of the opposing hole 62 is a slight concavity 64, of length illustrated by arrows 66 in FIG. 6. A corresponding concavity is provided on the opposing face of main clamping bar 36. The two portions of the clamping bar at either end of the concavities define a clamping bar mounting pod 98. Auxiliary clamping bars 34 and 38 are similar in construction to main clamping bar 36, but include concavity 64 on only the inwardly directed faces thereof.

Referring to FIG. 6 together with FIG. 4, the presence of the tapered bottom portions 60 enables clamping bars 34, 36 and 38 to fit within clamping channels 16, 18 and 20 respectively. Holes (not visible) extend through the face of the base member opposite the clamping channels to align with the corresponding holes 62 in the clamping bars 34, 36 and 38. Socket head cap screws 68 suitably engage the threaded holes 62 in the clamping bars through the base member to hold the bars securely within the clamping channels. Since the width of the bottom edge of a particular reed petal, illustrated at arrows 70, is slightly less than the length of clamping bar concavity 64, illustrated at arrows 66, the clamping bar tightly holds the reed petal against the base of the reed cage without damaging the reed petal by crushing. This arrangement provides a relatively even clamping pressure across the width of the reed petal. Preload is established by the thickness of the reed petal relative to concavity 64. The force of the socket head cap screw is captured at the junction of the clamping bar mounting pod 98 and clamping channels 16, 18 and 20.

Figure 10:
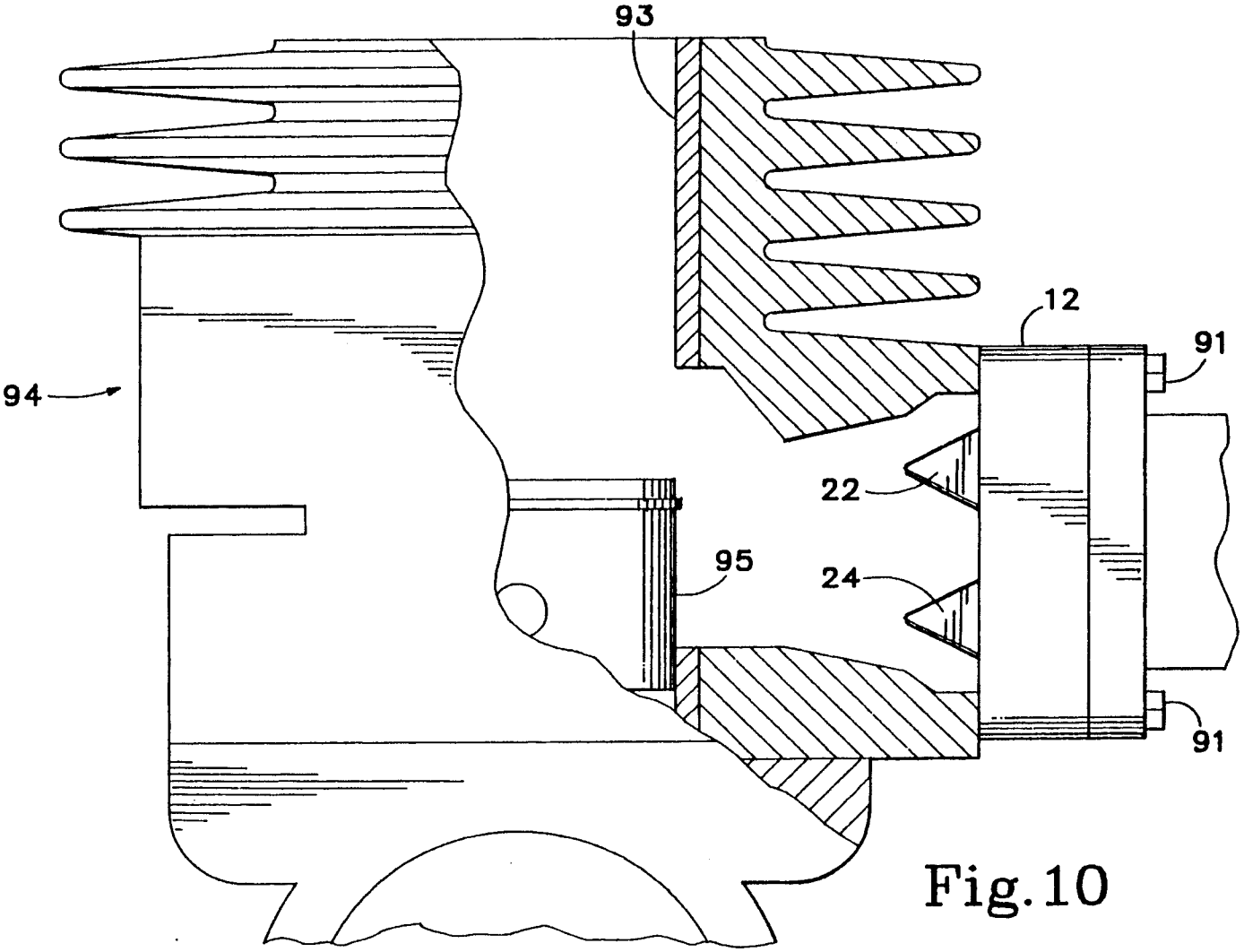
FIG. 10 is an exemplary view of the second embodiment of the reed valve assembly installed within an internal combustion engine.

Referring to FIG. 10, the reed valve assembly is attached to the engine, suitably a two-cycle piston engine, at the fuel/air intake, between the carburetor and the cylinder 93, via bolts 91 through mounting holes 14 (FIG. 5). The reed valve assembly is oriented such that the vertices of the reed cage face towards the "downstream" side of fuel/air flow relative to the carburetor, i.e., during fuel/air intake, the fuel/air mixture will flow from the carburetor, through the reed valve assembly towards cylinder 93 and piston 95. When so positioned, the petals will flex away from their respective reed cage faces and auxiliary faces to open apertures 40, 42 and 44 (not visible in FIG. 10) and enable fuel/air flow from the carburetor into the cylinder, but will flex back against the reed cage faces and auxiliary faces to prevent reverse fuel/air flow from the cylinder towards the carburetor. In typical operation, a greater volume of fuel/air will pass through the apertures of reed cage faces 22 and 24 than will pass through auxiliary faces 23 and 25, thus their designation as auxiliary. The reed valve assembly may also be employed as a case valve, between the fuel/air intake and the engine crank case rather than or in addition to between the fuel/air intake and the engine cylinder.

Figure 7:
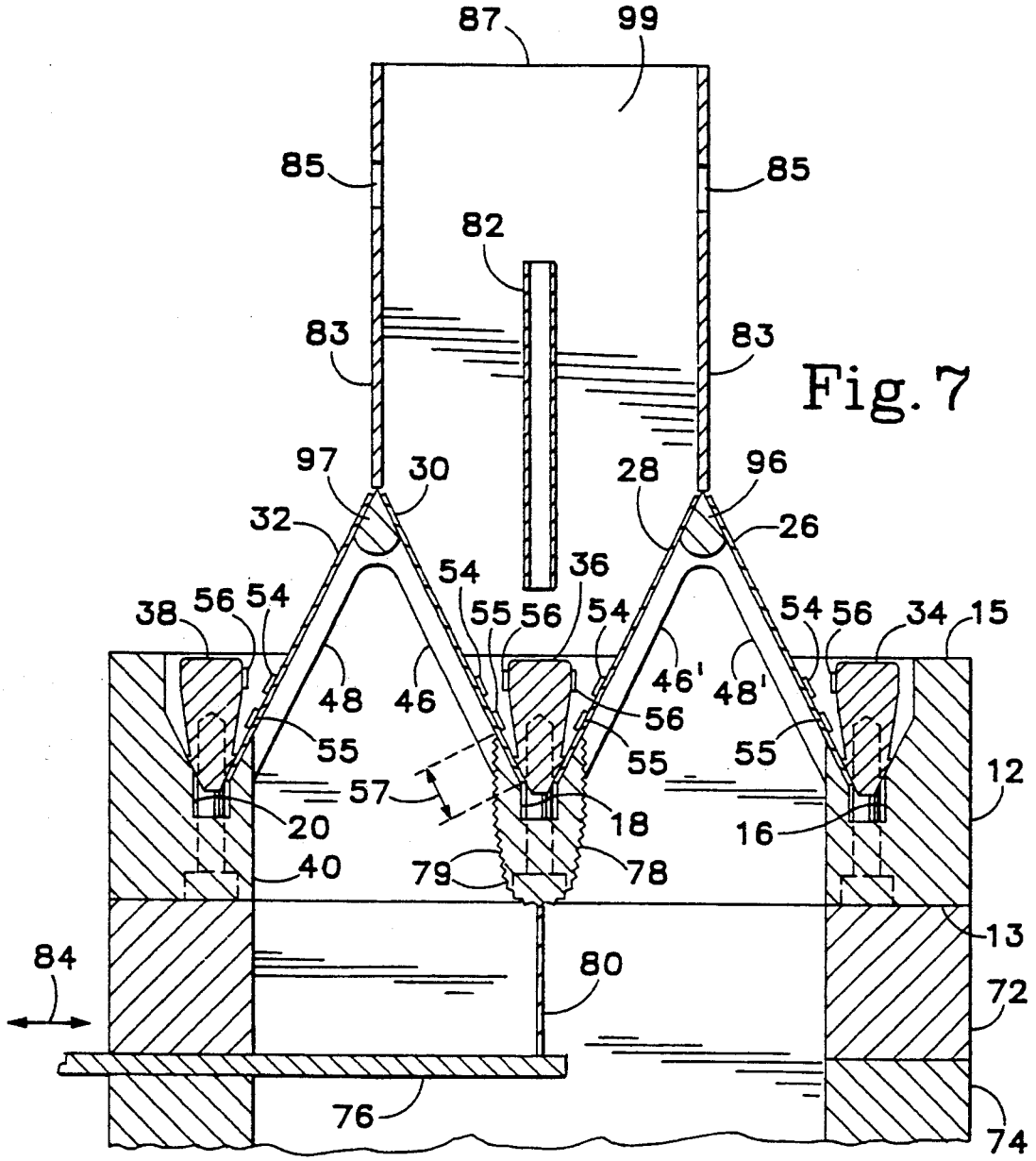
FIG. 7 is a section view of a modification of the reed valve assembly of FIG. 5 installed within an internal combustion engine.
Figure 8:
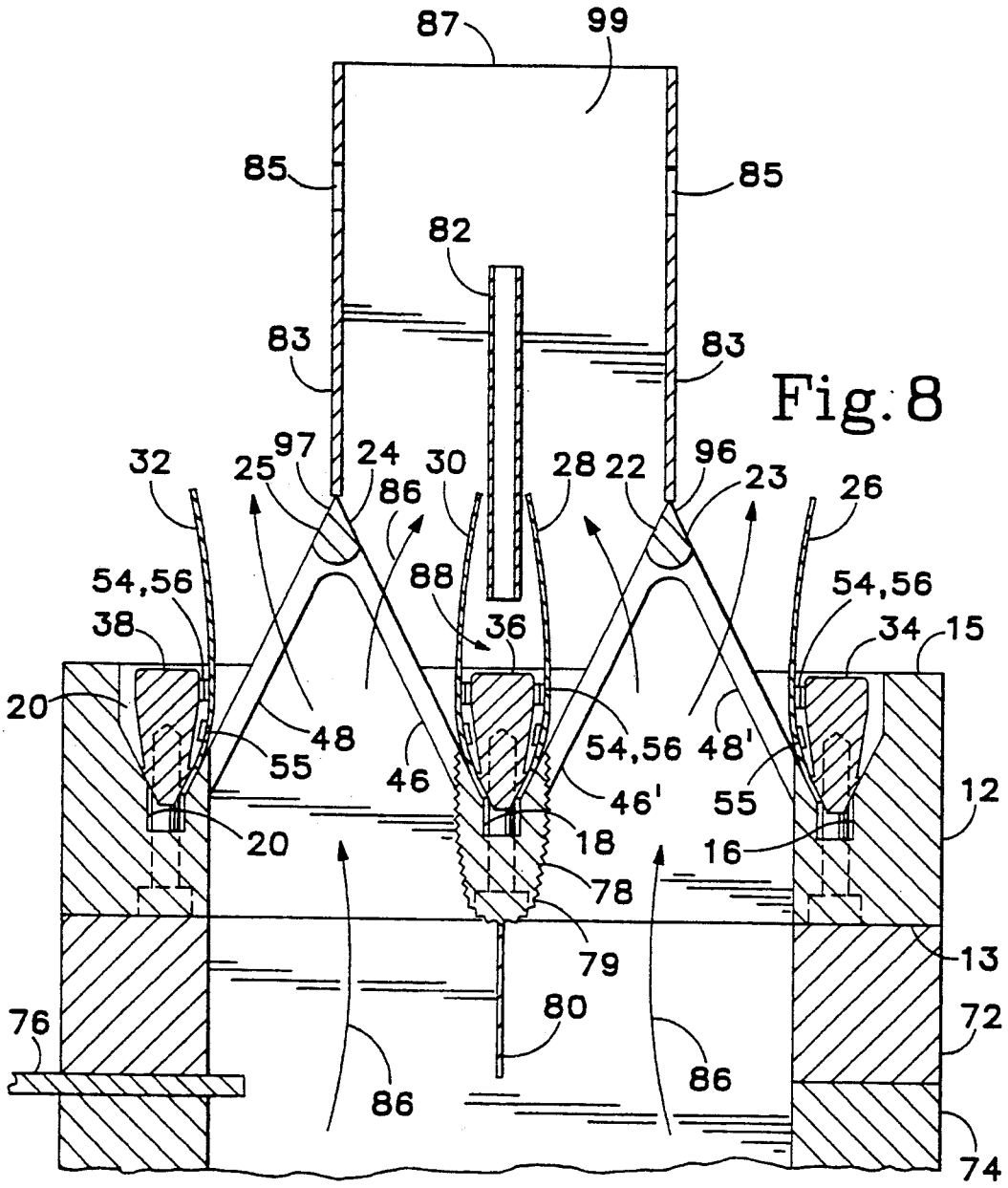
FIG. 8 is a section view of the reed valve assembly of FIG. 7 with the reeds in the open state illustrating fuel/air flow therethrough.

FIG. 7 is a section view along a line corresponding to the line 7—7 of FIG. 5 with the petals in the closed state and FIG. 8 is a section view similar to FIG. 7 with the petals in the open state illustrating fuel/air flow through the valve. In FIG. 7, the base member 12 is mounted against intake flange 72. When so mounted, the reed valve assembly has a face 13 that is upstream and a face 15 that is downstream relative to fuel/air flow. Upstream from the reed valve is carburetor 74, which, as illustrated, includes slide 76, movable along line 84 and shown in a partially open state. The distance between carburetor 74 and the reed valve assembly is not necessarily shown to scale.

Taking petal 30 as an example, a strip 54 extends the length of the external face of petal 30, and is formed of a magnetic material, e.g., a ferromagnetic strip. A corresponding strip 56 of similar length is placed on a face of clamping bar 36, facing toward petal 30, strip 56 suitably comprising a magnetic material. The other face of bar 36 has a corresponding strip 56, as do the inward faces of clamping bars 34 and 38. The external faces of petals 26, 28 and 32 also carry strips 54. The petals may be provided with vibration dampening by the addition of visco-elastic polymer strips 55 placed along the base of the petals. The strips suitably comprise strips of polymer sold under the tradename sorbothane.

Taking reed face 24 as an example, an area 57 shown in FIG. 7, at the base of the reed face is suitably formed with its surface at a slight angle, e.g. four degrees, relative to the rest of the face, so that the petal is forced to be tightly pressed against the rest of the face when in the closed position. This slight angle creates a closed position seat pressure for the petal so as to provide an effective petal-to-face seal.

The support members 48 and 48' provide extra support to the reed petals 26 and 32 in the central portion of the apertures 44 when the petals are in the closed position. The members are formed with curved leading edges, in order to reduce turbulence within the fuel/air stream. Central portion 78 may also be formed with shallow longitudinal grooves 79 (illustrated in exaggerated form) on the face thereof in order to create microturbulances during operation, for assisting in preventing fuel from pooling on the surface of portion 78 and to assist in keeping the fuel in the desired atomized state. Extending from the upstream face of portion 78 is an optional divider member 80, which may either extend partially to or all the way to the carburetor.

A venturi tube assembly 87, adapted to fit over the downstream face of the reed value, includes outer wall members 83, which extend downstream from cage outer vertices 96 and 97, and end walls 99 which extend from face 15 of base member 12 connecting the two outer wall members so as to form an open ended box over the central portion of the reed valve assembly. Assembly 87 also includes a pressure transfer tube 82, centrally positioned between petals 28 and 30, some distance above clamping bar 36. The pressure transfer tube extends downstream some distance beyond the vertices of the reed cage. The wall members 83 suitably extend downstream beyond the end of pressure transfer tube 82, and may include apertures 85 therein, some distance beyond the downstream end of the pressure transfer tube. The wall members 83 serve to direct the fuel/air flow downstream from the valve assembly and direct the air stream to move past the downstream end of the pressure transfer tube. Assembly 87 and central reed petals 28 and 30 are constructed to provide a close fit between the assembly end walls 99 and the petals at the sides of the petals, to minimize fuel/air passage around the sides of the petals, thus creating an amplified low pressure area 88 between petals 28 and 30 so as to extend their open duration while at the open position. End walls 99 suitably extend to the downstream face 15 of base member 12.

In the illustration of FIG. 7, the reed petals are shown in a closed state. Referring to FIG. 8, the reed petals are illustrated in the fully open state. It may be observed that with the reed petals in their open state, the magnetic strips 56 on the clamp members meet the corresponding strips 54 on the reed petals, to assist in keeping the reed petals in the fully open state, or alternatively to repel and assist in closing the reed petals. Which alternative is employed is determined by operating range and performance characteristics desired. For example, in an application within a high r.p.m. engine, the strips 54 and 56 are most suitably arranged so as to urge the petals to the closed state. Lower r.p.m. applications would employ strips 54 and 56 that urge the petals to remain open. Slide 76 is shown in a more fully open position in FIG. 8, as would arise when the engine throttle was opened more fully. Fuel and air flow 86 comes from the carburetor, through the reed valve assembly, pushing the reed petals into the open state, and continuing on to the engine cylinder. The pressure transfer tube 82, which extends to a region of low pressure created by the rejoining of the two accelerated air streams which had originally been divided by portion 78, communicates the low pressure to region 88, reducing the pressure between the two reed petals 28 and 30 when fuel/air is flowing through the reed valve and past the downstream end of the pressure transfer tube. This reduced pressure further assists in the reed petals more fully opening and will cause the petal tips to touch tube 82, creating a low pressure chamber 88 which effectively increases the open duration of reed petals 28 and 30. Optional divider 80 provides a smaller volume through which the fuel/air flows when carburetor slide 76 is not fully open, thus maintaining a higher flow velocity through the reed valve even though the throttle is only partially open. Divider 80, by halving the flow area on the upstream side of the valve faces, effectively increases the expansion wavefront strength, therefore increasing the flow velocity. The increased flow velocity translates to more effective atomization of fuel through the carburetor and in the intake tract as well, resulting in a favorably enhanced engine performance. Of course, once the carburetor slide is more fully opened, as in FIG. 8, fuel/air mixture passes at a higher flow rate through the reed valve assembly and therefore, restricting flow to one portion of the assembly is not as important. Once the engine completes an intake cycle, the flow of fuel/air will stop, and the reed petals will return to their closed state, effectively sealing the apertures to prevent back flow from the cylinder to the carburetor.

Figure 9:
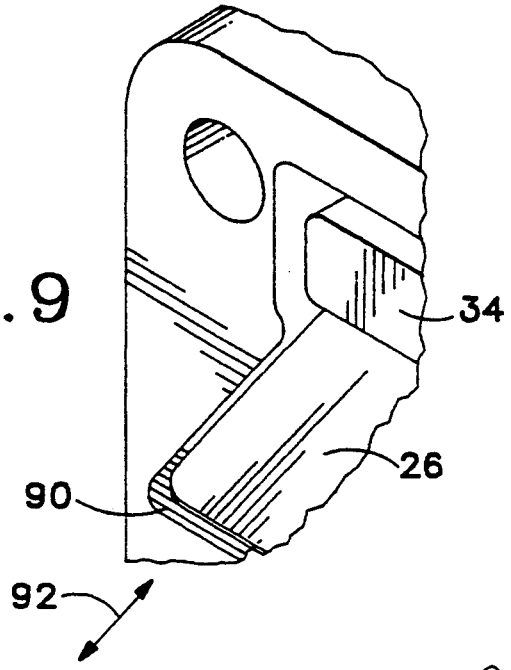
FIG. 9 is an enlarged perspective view of a portion of a valve assembly.

Referring now to FIG. 9, the adjustment of reed petal tension will be described. Each reed cage face and auxiliary face carries a number of regularly spaced stripes 90 extending the entire width of the face from the outer vertex thereof down to the opening of aperture 44. These stripes, suitably being 0.025 inches apart, may be formed as shallow grooves, and serve as marking gauges for adjusting the reed petals. Each reed petal is slidably adjustable along the axis defined by arrow 92 to sit higher up or lower down relative to the inner vertex of the reed cage. Referring to FIG. 6 and FIG. 9 together, when the reed petal is sitting higher up relative to the reed cage, then the cooperation of U-shaped cut outs 50 and the clamping bar results in the petal being less resistant to flexing, and therefore more easily opened, since the clamping force is exerted over a narrower width of reed petal material. Conversely, when the petal is moved further down, then more area of the petal is firmly engaged by the clamping bar, resulting in a much stiffer flexing petal. The stripes 90 may be employed as gauge marks to assist in adjusting the petals for optimal performance. To perform the adjustment, the engine mechanic removes the reed valve assembly from the engine and loosens each of the socket head cap screws 68 approximately one full turn. Then, the mechanic slides each reed petal either up or down the faces of the reed cage, using stripes 90 to gauge the amount to move the petals, retightening the socket head cap screws after the petals have been moved. Thus, when adjusting an engine employing the reed valve assembly, to move the power band up in r.p.m., the reed petals should be stiffer, and a particular reed petal is adjusted to be lower down the reed cage and engaged by the clamping bars further up on the petal. The cooperation of the clamping bar with the cut outs on the reed petal results in stiffer flexing. Alternatively, to move the power band down in r.p.m., the reed petal should be adjusted to ride higher on the reed cage, thereby resulting in clamping along a more flexible portion of the petal and enabling greater petal opening at lower flow volumes.

Employing the socket head cap screws and clamping bar configuration as illustrated provides an advantage over other reed valves. The socket head cap screws are on the upstream side of the valve assembly, and would not be sucked into the engine in the event that a cap screw came loose during engine operation.

In the preferred embodiment of the invention, the reed petals are suitably made from carbon fiber cloth, with a first layer of carbon fiber cloth being overlayed with a second layer of carbon fiber cloth, rotated with respect to the first layer such that the warp and weft of one layer are at a forty-five degree angle relative to the warp and weft of the other layer. The first and second layers are fused together and cut to shape. Employing these two rotated layers provides the petals with torsional stability and greater resistance to delamination, enabling use of a single petal along each face of the reed cage. Each layer of the cloth preferably comprises plain weave 45×45 count AvCarb brand carbon fabric having tensile modulus of 38.0 msi and elongation at break of 0.72%, part number CPW-003, sold by Textron Specialty Materials of Lowell, Mass. The layers are suitably fused employing 350° F. curing epoxy resin, part number BT350 E-1, sold by Bryte Technologies, Inc. of Milpitas, Calif. Each petal carries five cut outs 50 as illustrated, but other quantities and configurations of cut outs may be employed to provide different flexibility adjustment.

The magnets 56 employed in the preferred embodiment are suitably so-called NEO magnets, formed of the iron, boron and neodymium compound $Nd_2Fe_{14}B$, which has excellent permanent-magnetic properties. In addition to neodymium, the NEO magnets may also contain other rare earth metals and in addition to iron also other transition metals. Base member 12, portion 78 of base member 12, support members 46, 48, 46' and 48', reed cage 21, and the various apertures therein are suitably milled from a single solid 6061 T6 heat treated aluminum billet. Clamping bars 34, 36 and 38 are suitably machined from 7075 T6 heat treated aluminum plate stock.

As noted hereinabove, the details of the embodiment employing two main reed petals and two auxiliary reed petals are similar to the details of the embodiment employing only two main petals, but the reed cage and reed petals in the embodiment without auxiliary petals are somewhat larger than in the auxiliary petal embodiment, in order to accommodate the entire volume of fuel/air flow through just two apertures in the base member and reed cage. The auxiliary petal embodiment allows more fuel/air flow in a more compact area than with the two main petal only arrangement and enables lighter and therefore more quickly and easily flexing petals to be used.

Also, while portion 78 of base member 12 is illustrated as extending only to the upstream edge of base member 12, portion 78 may also be designed to extend significantly further towards the carburetor, in addition to or in place of divider member 80.

It will therefore be appreciated that the present invention is not restricted to the particular embodiments that have been described, and that variations may be made therein without departing from the scope of the invention as defined in the appended claims and equivalents thereof. For example, an alternative embodiment may employ electro-magnets in place of permanent magnets 56, with the operation thereof keyed to the operation of the engine, such that the electro-magnets are energized when the valve petals are most desirably open and are de-energized or field reversed when the valve petals should be closed.

I claim:

1. A reed valve for use in an internal combustion engine comprising:

a base member adapted for mounting in a fuel and air supply conduit of the internal combustion engine, said base member having an upstream face and a downstream face and having a channel defined in the downstream face thereof, said channel having first and second longitudinal edges, said base member having a first valve passage and a second valve passage defined adjacent the first and second longitudinal edges of said channel for enabling fuel and air to flow from the upstream face of said base member to the downstream face thereof;

a reed cage having a first reed cage face extending obliquely from the first longitudinal edge of the channel over said first valve passage to beyond the downstream face of said base member and a second reed cage face extending obliquely from the second longitudinal edge of the channel over said second valve passage to beyond the downstream face of said base member;

a first flexible reed petal adapted to fit along the base of said first reed cage face and extending towards the vertex of said first reed cage face so as to substantially cover said first valve passage when in a closed state; and a second flexible reed petal adapted to fit along the base of said second reed cage face and extending towards the vertex of said second reed cage face so as to substantially cover said second valve passage when in a closed state, wherein said first and second flexible reed petals flex towards one another when in the open state.

2. A reed valve according to claim 1, further comprising a venturi tube having first and second open ends, the first open end being placed centrally between the bases of said first flexible reed petal and said second flexible reed petal, and the second open end of said venturi tube being positioned beyond the downstream face of said base member and beyond the vertices of said first and second reed cage faces for providing a reduced pressure between said first flexible reed petal and said second flexible reed petal when said petals are in an open state, thereby urging said petals to an open state.

3. A reed valve according to claim 2, wherein said venturi tube is formed as a portion of an assembly for directing air flow downstream from said first and second reed cage faces and adapted to fit over said reed cage.

4. A reed valve according to claim 1, further comprising means for urging said first and said second reed petals to fully open once in an open state.

5. A reed valve according to claim 4, wherein said means for urging comprises:

a magnetically attractant means; and a corresponding magnetically attracted means, one of said magnetically attractant means and said magnetically attracted means being affixed on a surface of said first reed petal and the other of said magnetically attractant means and said magnetically attracted means being affixed relative to said base member in spaced relation with said first reed petal.

6. A reed valve according to claim 5, wherein said first magnetically attractant means comprises a permanent magnet.

7. A reed valve according to claim 1, further comprising means for urging said first and said second reed petals to fully close once fuel and air flow through said first and second valve passages is reduced.

8. A reed valve according to claim 1, wherein said first and second reed petals are discrete petals, further comprising means for securing said first and second flexible reed petals against the respective bases of said first and second reed cage faces for holding said reed petals in place while allowing adjustment of the flexing tension of said reed petals.

9. A reed valve according to claim 8, wherein said means for securing said first and second flexible reed petals comprises:

a clamping bar adapted to fit within said channel in said base member for clamping said first and second flexible reed petals against the bases of said first and second reed cage faces respectively, wherein said clamping bar is adapted to provide clamping of said first and said second reed petals over a range of positions relative to the base thereof for enabling adjustment of the flexing tension of said flexible reed petals; and means for securing said clamping bar within said channel.

10. A reed valve according to claim 9, wherein said clamping bar has concavities defined therein along the surfaces against which said first and second flexible reed petals will rest, for preventing crushing of the reed petals when said means for securing is tightened.

11. A reed valve according to claim 9, wherein said base means has at least one aperture extending from the upstream face thereof to the bottom of said channel and wherein said means for securing said clamping bar comprises fastener means adapted to extend through said at least one aperture to engage said clamping bar.

12. A reed valve according to claim 9, wherein said first and second flexible reed petals have a plurality of notches cut into their respective bases for providing enhanced flexibility to said flexible reed petals.

13. A reed valve according to claim 1, wherein said reed petals comprise carbon fiber petals.

14. A reed valve according to claim 1, wherein said first and second flexible reed petals have a plurality of notches cut into their respective bases for providing enhanced flexibility to said flexible reed petals.

15. A reed valve according to claim 1, wherein said first and said second reed cage faces carry adjustment marks for enabling gauging of tension adjustment of said first and second flexible reed petals.

16. A reed valve according to claim 1, wherein said base member has a second channel and a third channel defined in the downstream face thereof, said second channel having a first longitudinal edge and said third channel having a first longitudinal edge, said first valve passage also being defined adjacent the first longitudinal edge of said second channel, said second valve passage also being defined adjacent the first longitudinal edge of said third channel, wherein said reed cage also has a third reed cage face that extends obliquely from the first longitudinal edge of said second channel over said first valve passage to beyond the downstream face of said base member and a fourth reed cage face that extends obliquely from the first longitudinal edge of said third channel over said second valve passage to beyond the downstream face of said base member, further comprising:

a third flexible reed petal adapted to fit along the base of said third reed cage face along said second channel and extending towards the vertex of said third reed cage face so as to substantially cover said first valve passage in conjunction with said first flexible reed petal when in a closed state; and a fourth flexible reed petal adapted to fit along the base of said fourth reed cage face along said third channel and extending towards the vertex of said fourth reed cage face so as to substantially cover said second valve passage in conjunction with said second flexible reed petal when in a closed state.

17. A reed valve according to claim 1, wherein the portion of said base member at the bases of said first and second reed cage faces between said first and second valve passages is formed with aerodynamically curved leading edges.

18. A reed valve according to claim 17, wherein the portion of said base member at the bases of said first and second reed cage faces between said first and second valve passages is formed to create microturbulences at the surface thereof for encouraging fuel to stay off the surface.

19. An internal combustion engine comprising:

an engine housing having a fuel/air intake supply conduit for supplying a fuel/air mixture to the engine housing;

a reed valve mounted within the fuel/air intake supply conduit of the engine, said reed valve comprising, a base member adapted for mounting in the fuel/air intake supply conduit of the internal combustion engine, said base member having an upstream face and a downstream face and having a channel defined in the downstream face thereof, said channel having first and second longitudinal edges, said base member having a first valve passage and a second valve passage defined adjacent the first and second longitudinal edges of said channel for enabling fuel and air to flow from the upstream face of said base member to the downstream face thereof;

a reed cage having a first reed cage face extending obliquely from the first longitudinal edge of the channel over said first valve passage to beyond the downstream face of said base member and a second reed cage face extending obliquely from the second longitudinal edge of the channel over said second valve passage to beyond the downstream face of said base member;

a first flexible reed petal adapted to fit along the base of said first reed cage face and extending towards the vertex of said first reed cage face so as to substantially cover said first valve passage when in a closed state; and a second flexible reed petal adapted to fit along the base of said second reed cage face and extending towards the vertex of said second reed cage face so as to substantially cover said second valve passage when in a closed state, wherein said first and second flexible reed petals flex towards one another when in the open state.

20. An internal combustion engine according to claim 19, wherein said first and second reed petals are discrete petals, further comprising means for securing said first and second flexible reed petals against the respective bases of said first and second reed cage faces for holding said reed petals in place while allowing adjustment of the flexing tension of said reed petals.

21. An internal combustion engine according to claim 20, wherein said means for securing said first and second flexible reed petals comprises:

a clamping bar adapted to fit within said channel in said base member for clamping said first and second flexible reed petals against the bases of said first and second reed cage faces respectively, wherein said clamping bar is adapted to provide clamping of said first and said second reed petals over a range of positions relative to the base thereof for enabling adjustment of the flexing tension of said flexible reed petals; and means for securing said clamping bar within said channel.

22. An internal combustion engine according to claim 21, wherein said base member has at least one aperture extending from the upstream face thereof to the bottom of said channel and wherein said means for securing said clamping bar comprises fastener means adapted to extend through said at least one aperture to engage said clamping bar.

23. An internal combustion engine according to claim 19, further comprising a venturi tube having first and second open ends, the first open end being placed centrally between the bases of said first flexible reed petal and said second flexible reed petal, and the second open end of said venturi tube being positioned beyond the downstream face of said base member and beyond the vertices of said first and second reed cage faces for providing reduced pressure between said first flexible reed petal and said second flexible reed petal when said petals are in an open state, thereby urging said petals to an open state.

24. An internal combustion engine according to claim 19, wherein said base member has a second channel and a third channel defined in the downstream face thereof, said second channel having a first longitudinal edge and said third channel having a first longitudinal edge, said first valve passage also being defined adjacent the first longitudinal edge of said second channel, said second valve passage also being defined adjacent the first longitudinal edge of said third channel, wherein said reed cage also has a third reed cage face that extends obliquely from the first longitudinal edge of said second channel over said first valve passage to beyond the downstream face of said base member and a fourth reed cage face that extends obliquely from the first longitudinal edge of said third channel over said second valve passage to beyond the downstream face of said base member, further comprising:

a third flexible reed petal adapted to fit along the base of said third reed cage face along said second channel and extending towards the vertex of said third reed cage face so as to substantially cover said first valve passage in conjunction with said first flexible reed petal when in a closed state; and a fourth flexible reed petal adapted to fit along the base of said fourth reed cage face along said third channel and extending towards the vertex of said fourth reed cage face so as to substantially cover said second valve passage in conjunction with said second flexible reed petal when in a closed state.

25. An internal combustion engine according to claim 19 wherein the engine includes an air throttle slide assembly and wherein the portion of said base member at the bases of said first and second reed cage faces between said first and second valve passages extends substantially to the air throttle slide assembly.

* * * * *